United States Patent [19]

Doelter

[11] 4,275,467

[45] Jun. 30, 1981

[54] SLIDING CLASP FASTENERS AND GARMENTS, ARTICLES AND SHEETING HAVING SUCH FASTENERS

[75] Inventor: Gandolph Doelter, London, England

[73] Assignee: The New Zipper Company Limited, Slough, England

[21] Appl. No.: 14,846

[22] Filed: Feb. 26, 1979

[30] Foreign Application Priority Data

Mar. 1, 1978 [GB] United Kingdom ..... 8166/78
Jul. 4, 1978 [GB] United Kingdom ..... 28786/78

[51] Int. Cl.[3] ..... A41D 13/00; A44B 19/32

[52] U.S. Cl. ..... 2/82; 24/205.1 R; 24/205.16 R

[58] Field of Search ..... 24/205.1 R, 205.16; 2/2.1 R, 82

[56] References Cited

U.S. PATENT DOCUMENTS

| | | | |
|---|---|---|---|
| 2,472,156 | 6/1949 | Gerber | 24/205.16 R X |
| 2,517,748 | 8/1950 | Williams | 2/82 |
| 2,746,113 | 5/1956 | Williams | 24/205.1 R |
| 2,753,609 | 7/1956 | Gossner | 24/205.1 R |
| 3,082,501 | 3/1963 | Brown | 24/205.1 R |
| 3,643,264 | 2/1972 | Rector | 2/2.1 R |
| 3,668,745 | 6/1972 | Krupp | 24/205.1 R |
| 4,038,698 | 8/1977 | Smith | 2/82 |

FOREIGN PATENT DOCUMENTS

| | | | |
|---|---|---|---|
| 2262836 | 7/1974 | Fed. Rep. of Germany | 24/205.1 R |
| 314024 | 3/1930 | United Kingdom | 24/205.1 R |

*Primary Examiner*—Roy D. Frazier
*Assistant Examiner*—Peter A. Aschenbrenner
*Attorney, Agent, or Firm*—Fitzpatrick, Cella, Harper & Scinto

[57] ABSTRACT

A fluid tight sliding clasp open ended or separable continuous fastener has two parts each comprising a row of fastening elements secured to a strip of impervious flexible material and a slider operable to close at least one end of the fastener, the elements of the two rows creating a seal against fluid pressure acting transversely of the fastener. Each part has adjacent the end to be closed additional sealing means on that face of the respective strip which, in use, forms the inside face, the additional sealing means of each part being preshaped so that when said one end of the fastener is closed they lie in edge to edge contact and are under compression whereby a fluid tight seal is obtained therebetween for resisting, in use, fluid pressure acting longitudinally of the fastener at said one end of the fastener. The fastener is particularly designed for protective suits.

16 Claims, 8 Drawing Figures

SLIDING CLASP FASTENERS AND GARMENTS, ARTICLES AND SHEETING HAVING SUCH FASTENERS

BACKGROUND OF THE INVENTION

1. Field of the Invention

This invention relates to sliding clasp fasteners and to garments, articles and sheeting having such fasteners.

2. Prior Art

It is known to provide protective garments, such as survival or exposure suits, with a sliding clasp continuous fastener of the kind comprised of two parts each comprising a row of fastening elements secured to a strip of flexible material and a slider which is movable along the rows from one end to the other and is operative on movement in the closing direction to bring the elements of the two rows into interlocking engagement and so to close the fastener and on movement in the opening direction to separate the elements of the two rows. Such fasteners are capable of providing a substantially fluid tight closure along the fastener when the two parts are closed together. Examples of such a fastener are disclosed in British Pat. Nos. 879,771, 940,061 and 1,201,290 and its use is of considerable practical value in that it enables a large opening in a flexible article such as a protective suit to be readily opened and closed in a fluid tight manner.

However, it is often advantageous to employ an open ended fastener which has the two flexible strips separable at the end when the slider has been moved in the opening direction away from that end to open the fastener. Moreover, a separable fastener of which the two parts are separable at both ends of the fastener when the elements are disengaged by the slider has the advantage that the two parts may be entirely separated. Both such kinds of fasteners are, of course, well known but a problem arises when it is necessary, as in a protective suit, to provide an acceptable fluid tight seal at the or each open end longitudinally of the fastener. British Pat. No. 913,113 describes means for sealing two or more adjacent ends of fluid tight sliding clasp open ended or separable continuous fasteners. This invention is concerned with supplying a solution to the problem of sealing a single end of either such type of fastener against fluid pressure acting longitudinally of the fastener.

SUMMARY

According to the invention there is provided a fluid tight sliding clasp open ended or separable continuous fastener comprised of two parts each comprising a row of fastener elements secured to a strip of impervious flexible material and a slider which is movable along the rows from one end of the fastener towards the other end and is operative on movement in the closing direction to bring the elements of the two rows into interlocking fluid tight engagement against fluid pressure acting transversely of the fastener and so to close at least said one end of the fastener and on movement in the opening direction to separate the elements of the two rows, and each part having adjacent the end to be closed additional sealing means on that face of the respective strip which, in use, forms the inside face, the additional sealing means of each part being preshaped so that when said one end of the fastener is closed they lie in edge to edge contact and are under compression whereby a fluid tight seal is obtained therebetween for resisting, in use, fluid pressure acting longitudinally of the fastener at said one end of the fastener.

Preferably the sealing means of each part is a separately constructed fillet of impervious material secured to said face of the respective strip. Also the seal between said adjacent edges of the fillets is preferably a continuous seal extending from the strips of the fastener to the plane containing the exposed faces of the fillets.

In one embodiment of the invention the opposite edge of each fillet lies short of the free edge of the respective strip of the fastener, in which case said edge of each fillet is tapered to merge gradually into the face of the respective strip to preclude leakage along said edge. Additionally, it is preferred that a second fillet aligned laterally with each first-mentioned fillet is secured to the free edge of the repective strip, each said second fillet having a tapered free edge extending longitudinally of the fastener whereby when, in use, each part of the fastener is secured to the inner face of a sheet of material the tapered edge of each second fillet will merge gradually with the respective sheet of material to preclude leakage along said edge.

In another embodiment of the invention the opposite edge of each fillet extends beyond the free edge of the respective strip of the fastener and is tapered laterally of the fastener whereby when, in use, each part of the fastener is secured to the inner face of a sheet of material the tapered edge of each fillet will merge gradually with the respective sheet of material to preclude leakage along said edge.

In a further embodiment of the invention it is intended that each part of the fastener should be applied externally of a respective sheet of material, in which case the opposite edge of each fillet is normal to the inner face of the strip of the respective part of the fastener whereby said opposite edge of the fillet may form a butt joint with the edge of the sheet of material and has the same thickness as said sheet of material to preclude leakage along said edge.

Preferably the strip of each part of the fastener is formed of rubber impregnated fabric and the fillets are formed of rubber, each fillet being vulcanised to the respective strip. Alternatively, any other suitable impervious material may be employed, e.g. a synthetic rubber compound or polyvinyl chloride.

If desired, at least one of the fillets may be inclined to the longitudinal centreline of the fastener along which the slider is moved.

Also, a second slider may be provided to close and open the other end of the fastener.

The two parts of the fastener may each be secured, at least adjacent said one end, to respective edges of a sheet or sheets of impervious, elastic material.

The invention further provides a garment, article or sheeting incorporating at least one fastener in accordance with this invention.

In the case of a garment it may be a one-piece protective suit having the fastener extending from the collar or head piece of the suit towards and then a part way down one leg of the suit along a line which for the most part is parallel to but one side of the centreline of the suit, the end of the fastener at the collar or head piece of the suit being an open end. The suit may have further fasteners, for example at each cuff and/or each ankle of the suit. Alternatively, the garment may be a dry diving suit.

DESCRIPTION OF THE PREFERRED EMBODIMENTS

Figure 1:
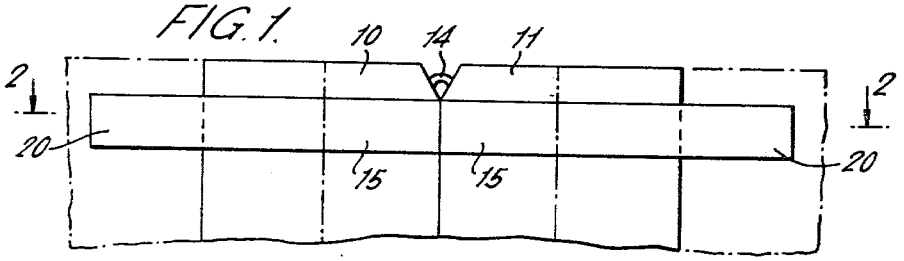
FIG. 1 is an elevation, by way of example, of the inner face of part of a fluid tight sliding clasp open ended continuous fastener when closed, the figure showing the sealing fillets of the fastener.

Each example of fastener shown in the drawings is a fluid tight sliding clasp continuous fastener which is of known design throughout the major portion of its length and is permanently sealed at one end, i.e. its closed end, by known means including a block of rubber moulded around the last few elements of the fastener. The difference between each fastener of the embodiments described below and conventional fluid tight fasteners is that one end may be opened fully to provide an open ended fastener, and it is this open end of such a fastener which is shown in FIG. 1. If desired, the other end of the fastener may be formed in the same manner to provide a separable fastener but the main function of this invention is to provide one open end which is all that is required in the manufacture of fasteners for, e.g. protective suits or dry diving suits. In such a case, it is advantageous to provide an open ended fastener having its open end at the collar of a suit, and further such fasteners may be provided, if desired, at the end of each arm and leg of the suit.

Figure 2:
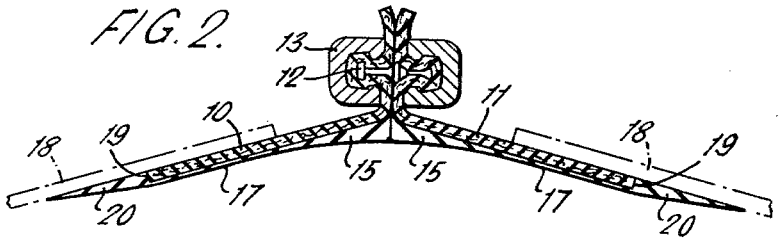
FIG. 2 is a section along line 2—2 in FIG. 1 the fastener being secured to two sheets of material shown in chain-dot lines.
Figure 3:
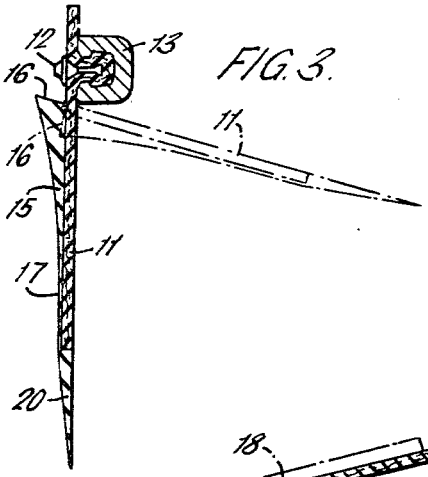
FIG. 3 is a section through one part of the fastener of FIG. 1 indicating the preshaped sealing edge of the respective fillet.

Referring to FIGS. 1 to 3, each part of the fastener comprises a flexible tape 10, 11 of rubber impregnated fabric, the two tapes being permanently united at the closed end (not shown) of the fastener as described above. Each part also comprises, in known manner, a row of inner elements 12 which are held in folds of the tapes by outer elements 13, the inner element of each row interlocking with the inner elements of the other row when the fastener has been closed by a slider 14.

Adjacent the open end of the fastener a wedge-shaped fillet 15 formed of rubber is secured by vulcanising to the inner face of each tape 10, 11. Each fillet 15 extends a short distance longitudinally of the respective tape 10, 11 and in this embodiment laterally beyond the free longitudinal edge of the tape. These fillets 15 provide a fluid tight seal extending longitudinally of the fastener from the direction of its open end. The edges of the fillets which are in contact when the fastener is closed are preshaped to give the required sealing effect. More particularly, FIG. 3, which indicates the shape of the edge 16 of each fillet 11 both when the tape 15 is flat during vulcanising of the fillet thereto and after the tape has been bent, shows that the edges 16 of the fillets 15 are formed so that they extend beyond but at an angle to the centreline of the fastener when it is open so that they will provide a compression seal when the fastener is closed. It will also be appreciated that the seal provided by the edges 16 of the fillets 15 is continuous from the tapes 10, 11 to the plane containing the exposed faces 17 of the fillets (see FIG. 2) and does not leave any open passage either adjacent the tape 10, 11 or the exposed faces of the fillets which, in use, would destroy the fluid tightness of the seal.

FIG. 2 indicates that, in use, the fastener of this embodiment is to be secured to two sheets 18 of impervious, elastic material applied to the outer faces of the tapes 10, 11. To avoid a leakage path along the edge 19 of each tape, each fillet 15 is provided with an extension 20 projecting laterally of the respective tape 10, 11 and is tapered at its free edge so that it merges gradually with the inner face of the sheet 18.

Figure 4:
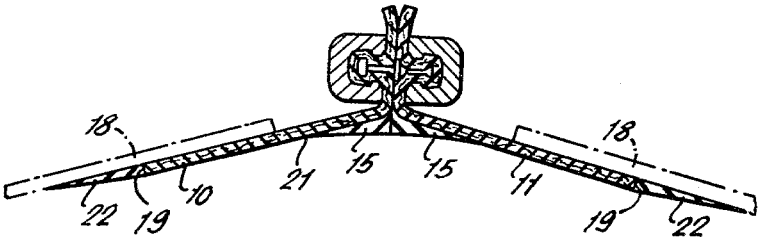
FIG. 4 is a section similar to FIG. 2 of a second embodiment of fastener.

FIG. 4 shows a second embodiment of fastener which is the same as the embodiment of FIGS. 1 to 3 except that the edge 21 of each fillet 15 which is opposite to the sealing edge lies short of the free edge 19 of the respective tape 10, 11. Thus, in this embodiment, the edge 21 of each fillet is tapered to merge gradually into the inner face of the respective tape 10, 11, and there is provided a separate second fillet 22 which corresponds to each fillet extension 20 of the embodiment of FIGS. 1 to 3.

Figure 5:
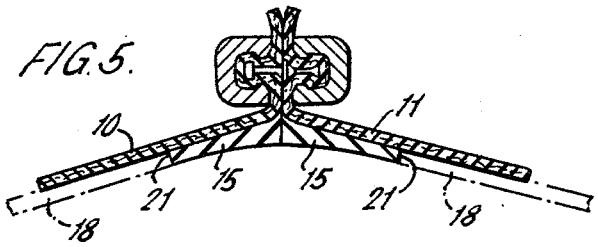
FIG. 5 is a section similar to FIG. 2 of a third embodiment of fastener.

A third embodiment (FIG. 5) differs from the previous embodiments in that, the sheets of material 18 are to be applied to the inner faces of the tapes 10, 11 of the fastener. This means that the edge 21 of each fillet is not tapered but lies normal to the inner face of the respective tape 10, 11 to provide a butt joint with the edge of the sheet 18.

Figure 6:
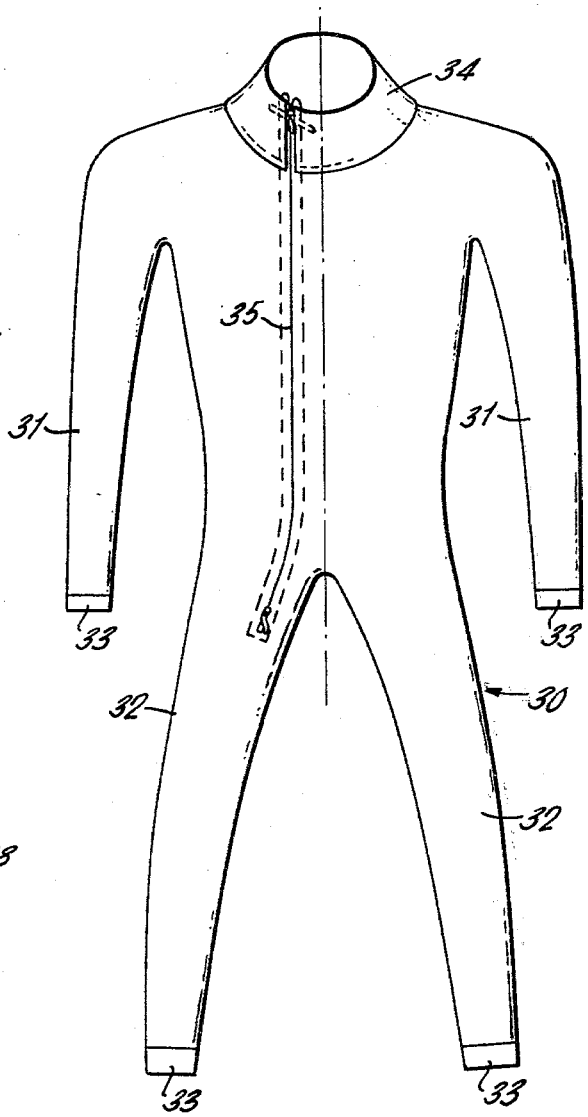
FIG. 6 shows a one-piece protective suit having a fastener similar to the fastener of FIGS. 1 to 3.
Figure 7:
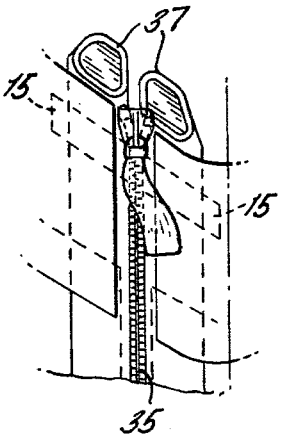
FIGS. 7 and 8 are detailed views of the open and closed ends respectively of the fastener of the protective suit of FIG. 6.

FIG. 6 shows a one-piece protective suit 30 made of conventional rubberised material, and having at the end of each arm 31 and leg 32 a sleeve 33 of impervious, elastic material, e.g. latex. The suit also has a collar 34 of impervious elastic material, e.g. latex, which is split longitudinally of the suit to allow the fastener 35 to have an open end. As is clear from the drawing, the fastener 35 extends from the collar 34 of the suit towards and then a part way down the right leg of the suit along a line which for the most part is parallel to but to one side of the centreline of the suit. The top end of the fastener (FIG. 7), i.e. the end at the collar 34 of the suit is an open end and is constructed substantially in accordance with the fastener of FIGS. 1 to 3. The main difference is that the sealing fillets 15 instead of being normal to the longitudinal centreline of the fastener are inclined thereto at the same angle as the cut of the collar 34 of the suit. Each part of the fastener also has a tag 37 to be held by the wearer to assist him to open the fastener. If desired, the two fillets 15 may be inclined at different angles to the centreline of the fastener. Indeed, in one specific embodiment, the left-hand fillet is as shown in FIG. 7 and the right-hand fillet is normal to the centreline of the fastener which has been found to assist the sealing effect of the fillets.

Figure 8:
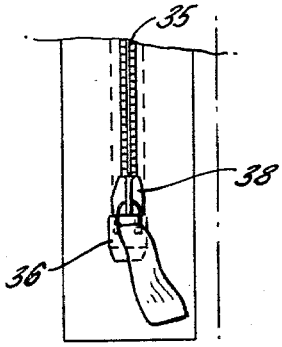

In this embodiment, the bottom end of the fastener 35 (FIG. 8) is a closed end having the conventional block 36 of rubber moulded around the last few elements of each part of the fastener. The bottom end of the fastener also has a second slider 38 which allows the fastener to be opened at a position adjacent the bottom end whilst leaving the remainder of the fastener closed. Before removing the protective suit, the wearer, of course, opens the fastener by means of the slider at the top end of the fastener. In the case of the suit having a head piece, it may be desirable for the open top end of the fastener to be disposed part way up the head piece instead of at the collar of the suit to make it easier for the wearer to put on and remove the suit.

It will be appreciated that the fastener, whether it is an open ended or a separable fastener, is suitable for incorporation in any garment, article or sheeting requiring such a sealed fastener.

Also, the fastener may be made of any suitable impervious material besides rubber. For example, each tape 10, 11 and the fillets 15 may be formed of a synthetic rubber compound or plastics material such as polyvinyl chloride. In this case, the garment, article or sheeting would be made of the same material or a compatible material. Indeed any material used heretofore for fluid tight fasteners may be employed.

I claim:

1. A fluid tight open ended or separable continuous fastener comprised of two rows of fastener elements secured to first and second strips of impervious flexible material, respectively, each having inside and outside faces, a slider which is movable along the rows from one end of the fastener towards the other end, said slider being operative on movement in the closing direction to bring the elements of the two rows into interlocking fluid tight engagement against fluid pressure acting transversely of the fastener and to close at least said one end of the fastener and on movement in the opening direction to separate the elements of the two rows, and an additional sealing means provided on the inside face of each of said strips adjacent the end to be closed, each said additional sealing means having an edge running longitudinally of said fastener so that when said one end of the fastener is closed said additional sealing means lie in edge to edge contact and said edges are held under sufficient compression by said slider across the entire contact area such that a fluid tight seal is obtained therebetween which resists fluid pressure acting longitudinally of the fastener at said one end thereof.

2. A fastener as claimed in claim 1, wherein each of said additional sealing means is a separately constructed fillet of impervious material secured to the inside face of the associated strip.

3. A fastener as claimed in claim 2, wherein the seal between said adjacent edges of the fillets is a continuous seal which extends from the free edge of each fastener strip to the plane containing the exposed faces of the fillets.

4. A fastener as claimed in claim 2, wherein the opposite edge of each fillet lies short of the free edge of the respective strip of the fastener and said edge of each fillet is tapered to merge gradually into the face of the respective strip to preclude leakage along said edge.

5. A fastener as claimed in claim 4, wherein a second fillet aligned laterally with each first-mentioned fillet is secured to the free edge of the respective strip, each said second fillet having a tapered free edge extending longitudinally of the fastener, whereby when each part of the fastener is secured to the inner face of a sheet of material, the tapered edge of each second fillet will merge gradually with the respective sheet of material to preclude leakage along said edge.

6. A fastener as claimed in claim 2, wherein the opposite edge of each fillet extends beyond the free edge of the respective strip of the fastener and is tapered laterally of the fastener, whereby when, in use, each part of the fastener is secured to the inner face of a sheet of material the tapered edge of each fillet will merge gradually with the respective sheet of material to preclude leakage along said edge.

7. A fastener as claimed in claim 2, wherein the opposite edge of each fillet is normal to the inner face of the strip of the respective part of the fastener whereby said opposite edge of the fillet forms a butt joint with the edge of a sheet of material to which said fastener is externally applied, said opposite edge having the same thickness as the sheet of material to preclude leakage along said edge.

8. A fastener as claimed in claim 2, wherein each strip of the fastener is formed of rubber impregnated fabric and the fillets are formed of rubber, and wherein each fillet is vulcanized to the respective strip.

9. A fastener as claimed in claim 2, wherein at least one of the fillets extends transversely at an oblique angle to the longitudinal centerline of the fastener along which the slider is movable.

10. A fastener as claimed in claim 1, further comprising a second slider provided to close and open the other end of the fastener.

11. A fastener as claimed in claim 1, wherein the two strips of the fastener are each secured, at least adjacent said one end, to respective edges of at least one sheet of impervious, elastic material.

12. A garment incorporating at least one fastener as claimed in claim 1.

13. A garment as claimed in claim 12, wherein the garment is a one-piece protective suit having the fastener extending from the collar of the suit towards and then part way down one leg of the suit along a line which for the most part is parallel to but to one side of the centerline of the suit, the end of the fastener at the collar of the suit being an open end.

14. An article incorporating at least one fastener as claimed in claim 1.

15. Sheeting incorporating at least one fastener as claimed in claim 1.

16. A fastener as claimed in claim 1, wherein said slider is moved beyond said additional sealing means when said one end of the fastener is closed to hold said edges under sufficient compression for the longitudinal fluid tight seal.

* * * * *